United States Patent [19]

Antonwitsch

[11] 4,279,744

[45] Jul. 21, 1981

[54] APPARATUS AND METHOD FOR REMOVING MAGNETIC ARTICLES FROM A FLOW OF LOOSELY PACKED MATERIAL

[75] Inventor: Lucien M. Antonwitsch, Summerland, Calif.

[73] Assignee: Jerry Oldenkamp, Santa Barbara, Calif.

[21] Appl. No.: 180,047

[22] Filed: Aug. 21, 1980

[51] Int. Cl.[3] ..... B03C 1/26

[52] U.S. Cl. ..... 209/214; 209/215; 209/222

[58] Field of Search ..... 209/38, 214, 215, 219, 209/222, 229

[56] References Cited

U.S. PATENT DOCUMENTS

| | | | |
|---|---|---|---|
| 3,926,792 | 12/1975 | Beford | 209/216 X |
| 3,960,716 | 6/1976 | Spodig | 209/220 |
| 3,980,562 | 9/1976 | Nilsson | 209/222 X |
| 4,106,627 | 8/1978 | Watanabe et al. | 209/38 X |

FOREIGN PATENT DOCUMENTS

| | | | |
|---|---|---|---|
| 80781 | 4/1956 | Netherlands | 209/219 |

*Primary Examiner*—William A. Cuchlinski, Jr.
*Attorney, Agent, or Firm*—Daniel J. Meaney, Jr.

[57] ABSTRACT

Apparatus for removing magnetic articles from a flow of loosely packed material containing a mixture of magnetic articles and non-magnetic articles having a rotatable elongated support shaft, a plurality of metal plates coaxially aligned in spaced parallel relationship with each other and coaxially aligned with and mounted on the elongated support shaft and rotatable therewith and wherein each of the metal plates extend substantially vertically outwardly from the elongated support shaft and by the material flow or by the elongated support shaft and a plurality of magnetic members coaxially aligned with and mounted on the elongated support shaft and located in the spaces between the metal plates wherein the magnetic members each extend substantially vertically outwardly from the support shaft and have a periphery which is spaced a predetermined distance from the periphery of the metal plates and wherein each magnetic member is formed of a magnetic material having a magnetic flux density of sufficient magnitude to magnetize each metal plate to attract and remove magnetic articles from the flow of loosely packed material and holding the so removed magnetic articles against the metal plates is shown. A method for removing magnetic articles from a free falling flow of the loosely packed material is shown.

21 Claims, 12 Drawing Figures

APPARATUS AND METHOD FOR REMOVING MAGNETIC ARTICLES FROM A FLOW OF LOOSELY PACKED MATERIAL

BACKGROUND OF THE INVENTION

1. Field of the Invention

This invention relates to apparatus and method for removing magnetic articles from a flow of loosely packed material containing a mixture of magnetic articles and non-magnetic articles. More specifically, this invention relates to apparatus for separating metal objects such as tableware and the like from rubbish having food and paper waste and to a method for removing magnetically attracted, reusable tableware and the like from a free fall flow of loosely packed material containing a mixture of magnetic articles and non-magnetic articles.

2. Description of the Prior Art

Methods and apparatus for separating magnetic articles from a flow of loosely packed material containing a mixture of magnetic articles and non-magnetic articles, such as for example tableware or other metal objects, from rubbish is well known in the art.

One apparatus and method disclosed in U.S. Pat. No. 3,926,792 automatically separates magnetic substances, such as tableware, from non-magnetic substances, such as food and paper waste. The apparatus disclosed in U.S. Pat. No. 3,926,792 utilizes a conventional endless conveyor belt, pulleys mounted at opposite ends of a steel frame and a pair of magnets mounted inside the interior of the pulley located at the discharge end of the conveyor to establish a magnetic field force extending radially through the conveyor belt around the pulley. The magnetic field attracts the magnetic substances, such as tableware, and holds the same against the surface of the conveyor belt. As the conveyor belt moves around the pulley, the food and paper waste fall from the end of the conveyor belt by gravity into a suitable trash receptacle while the attracted tableware remains against the conveyor belt until the tableware is transported and released into a separate receptacle. A similar method and apparatus, which is used for crushing and separating metallic containers and having a conveyor and magnetic pulley arrangement is disclosed in U.S. Pat. No. 4,084,496.

Other apparatus which utilize conveyor belts and a magnetic pulley or magnetic drum for separating magnetic materials from non-magnetic materials are disclosed in U.S. Pat. Nos. 2,844,251 and 2,964,184, respectively.

Apparatus for salvaging metal articles from rubbish is disclosed in U.S. Pat. No. 2,913,113 and utilizes a rotating drum having an inlet for receiving rubbish containing the metal articles and internal fins which agitate the rubbish into a falling stream of loose mixed rubbish. The rubbish stream falls near a helical magnet extending axially through the center of the drum wherein the helical magnet attracts the metal articles thereagainst and transports the same axially to the end thereof where the metal articles are removed therefrom. The nonmagnetic substances forming the balance of the rubbish are discharged from the outlet of the drum.

A circular magnet in combination with a spinning non-magnetic disc member wherein the magnetic field developed from the magnet attracts and separates magnetic parts from rubbish into engagement with a spinning disc and the disc impells the separated magnetic part along a predetermined path for collection thereof is disclosed in U.S. Pat. No. 2,766,887.

Magnetic separators having various shapes and sizes of coaxially aligned magnetic members are disclosed in U.S. Pat. Nos. 1,129,822; 2,858,021; 2,094,615; 2,992,733; 2,992,734; 3,998,741 and 4,046,680. One magnetic separator having axially aligned magnets is disclosed in U.S. Pat. No. 3,960,716 and relates to a magnetic separator for dry and wet material containing magnetically attractable particles. The magnetic separator includes a stationary vertical housing which provides a vertical path for gravity movement of material within the housing and a rotating magnetic system concentrically arranged along the vertical axis of the housing. The magnetic system which is rotated by a drive means, comprises a plurality of magnetic discs and pole discs alternating with the magnetic discs in the axial direction of the housing.

SUMMARY OF THE INVENTION

The present invention discloses a novel and unique apparatus for removing magnetic articles from a flow of loosely packed material containing a mixture of magnetic articles and non-magnetic articles. In the preferred embodiment, the apparatus includes an elongated support shaft which is adapted to be rotated about its longitudinal axis. First and second metal plates coaxially aligned in spaced parallel relationship with each other are coaxially aligned with and mounted on the elongated support shaft so as to be rotatable therewith. Each of the metal plates extend substantially vertically outwardly from the elongated support shaft and each have a periphery which is adapted to engage and be rotated by the flow of loosely packed material impacting against the metal plates or by the rotation of the elongated support shaft. A magnetic member, which is coaxially aligned with and mounted on the elongated support shaft, is located in the space between the first and second metal plates and in axial alignment with and contiguous the first and second metal plates. The magnetic member extends substantially vertically outwardly from the support shaft and has a periphery spaced a predetermined distance from the periphery of each of the first and second metal plates. The magnetic members are formed of a magnetic material having a magnetic flux density of a sufficient magnitude to magnetize each metal plate and to produce a preshaped magnetic field emanating therefrom which attracts and removes magnetic articles responsive to the magnetic field from the material flow being directed across the metal plates. The magnetic field emanating from the metal plates hold the removed magnetic articles thereagainst as the metal plates move relative to the material flow being directed thereacross.

This invention also relates to a novel and unique method for removing magnetically attracted, reusable tableware and the like from a flow of loosely packed material containing a mixture of magnetic articles and non-magnetic articles including food and paper waste.

The known prior art devices for separating magnetic substances, such as tableware, from non-magnetic substances such as food and paper waste generally comprise apparatus which are fairly large in size. In addition, the apparatus have a plurality of moving parts including endless conveyor belts, magnetic pulleys and the like. Other known apparatus for salvaging metal articles from rubbish utilize rotating drums, elongated rotating helical magnets located axially to the center of the drums or combinations of circular magnets and spinning non-magnetic disc members for attracting and separating magnetic parts from rubbish, all of which require bulky apparatus, driving means and associated mechanisms to attract, separate and transport magnetic articles from non-magnetic articles contained in the rubbish.

The present invention discloses apparatus for removing magnetic articles from a flow of loosely packed material containing a mixture of magnetic articles and non-magnetic articles and eliminates the necessity for endless conveyor belts having magnetic pulleys, drive means, helical magnets or other large or complicated transporting and separating apparatus.

One advantage of the present invention is that the apparatus for removing magnetic articles is relatively simple in contruction, formed of a minimum number of mechanical components and is adapted to be rotated by the free fall of the flow of loosely packed material containing a mixture of magnetic articles and non-magnetic articles including food and paper waste or by manual rotation of an annular disc.

Another advantage of the present invention is that the apparatus for moving the magnetic articles has a size and weight so that the same can be positioned onto the top of a conventional receptacle for the collection of trash. The apparatus when mounted onto the top rim of a receptacle is adapted to have rubbish dumped thereon such that a flow of loosely packed material containing a mixture of magnetic articles and non-magnetic articles either directly impacts upon the metal plates of the apparatus so as to cause rotation thereof or to pass adjacent to the metal plates. Thus, rubbish can be directed into a trash receptacle in a normal manner such as by dumping the refuse or rubbish into the receptacle or transporting the rubbish by means of a simple conveyor to the receptacle.

A yet further advantage of the present invention is that the apparatus is formed of a plurality of metal plates and a plurality of magnetic members interdispersed between the plates resulting in a simple apparatus having a strong preshaped magnetic field emanating therefrom.

A still further advantage of the present invention is that the apparatus can be used without the necessity of complex conveyer belts, driving means for rotating the magnetic assembly and separate collecting means for receiving and storing the magnetic articles removed from the flow of loosely packed material containing a mixture of magnetic articles and non-magnetic articles.

A still yet further advantage of the present invention is that the apparatus for removing the magnetic articles is relatively economical to construct, can be used in small restaurants, shops or businesses which have a relatively low volume of rubbish and which is adapted to be used either as a portable unit which is easily moved from one rubbish receptacle to another rubbish receptacle or mounted in a permanent installation which is adapted to have a removable rubbish receptacle stored thereunder.

BRIEF DESCRIPTION OF THE DRAWING

These and other objects and advantages of the invention, together with its various features and advantages, can be more easily understood from the following more detailed description of the preferred embodiment taken in conjunction with the accompanying drawing in which.

DESCRIPTION OF THE PREFERRED EMBODIMENT

Figure 1:
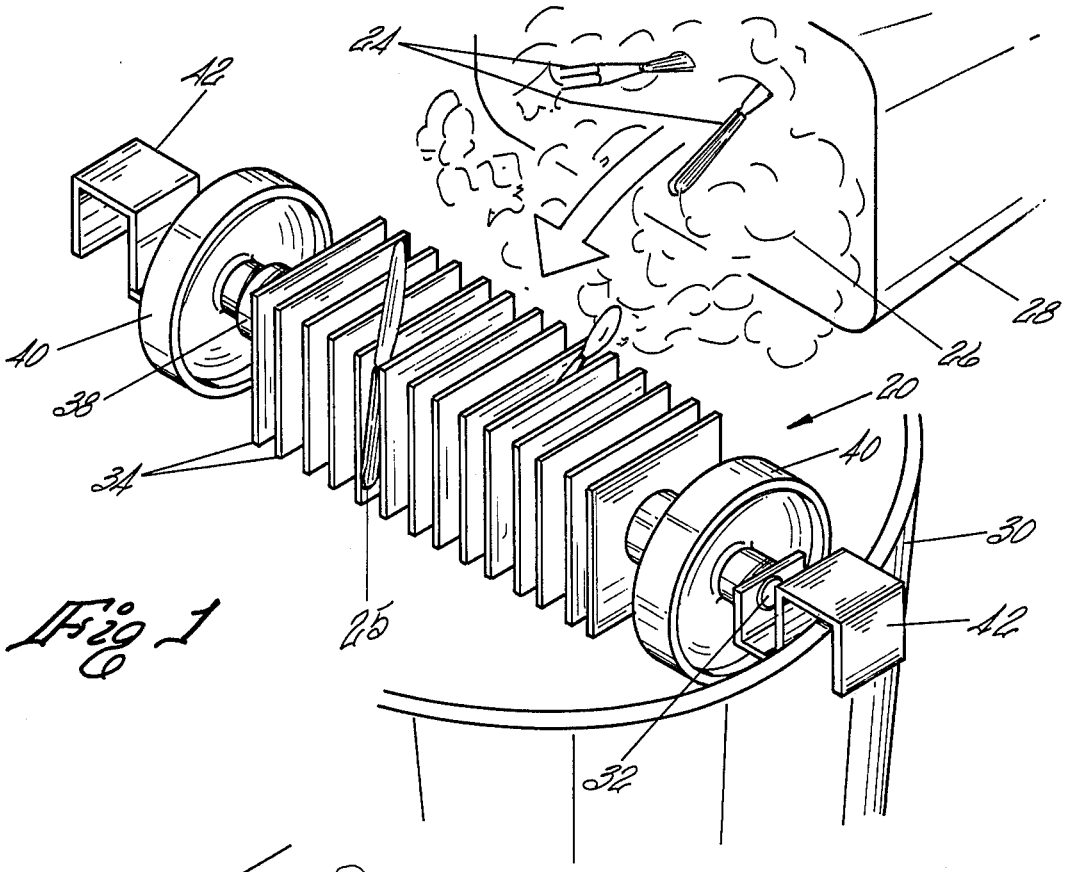
FIG. 1 is a perspective view of an apparatus for removing magnetic articles using the teachings of this invention removably mounted on the top of a trash receiving receptacle and adapted to have a flow of loosely packed material containing a mixture of magnetic articles and non-magnetic articles dumped thereon from a trash collection receptacle.

In FIG. 1, the apparatus for removing magnetic articles is generally designated by arrow 20. The magnetic articles, which may be reusable tableware and the like, such as silverware 24 are contained in a loosely packed material, 26, which contains a mixture of magnetic articles and non-magnetic articles. Typically, the non-magnetic articles include rubbish collected from the operation of a business such as a restaurant business or the like and generally contains food and paper waste. In a typical business, the rubbish is collected in a rubbish or trash collection receptacle, such as a waste basket 28.

The apparatus for removing magnetic articles 20 is illustrated, in its preferred embodiment, as a portable or removable device which is adapted to be mounted upon the top of a conventional trash receiving receptacle such as a rubbish can 30. A business such as a restaurant normally utilizes a waste basket 28, or a similar type rubbish collector, for accumulating loosely packed material in the form of food, paper waste and other debris. In use, the waste basket 28 is dumped into a large trash receptacle 30 and the loosely packed material containing a mixture of magnetic articles and non-magnetic articles is directed across the apparatus 20.

In the preferred embodiment, the apparatus includes an elongated support shaft which is adapted to be rotated about an elongated support pin 32. A plurality of metal plates such as the metal plates 34, are coaxially aligned in spaced parallel relationship with each other and coaxially aligned with and mounted on the elongated support shaft to be rotatable therewith. Each of the metal plates 34 extend substantially vertically outwardly from the elongated support shaft. Each of the metal plates 34 have a periphery which is adapted to engage and be rotated by a material flow being directed thereacross or by rotation of an annular shaped driving disc 40. An operator can rotate the metal plates 34 by rotating the annular driving disc 40. The annular driving disc 40 is spaced from a support housing 42 by means of non-magnetic spaces 38. The support housing 42 supports the apparatus to elongated support pins 32 to permit rotation of the interlocking assembly formed of the elongated support shaft and metal plates 34.

Figure 4:
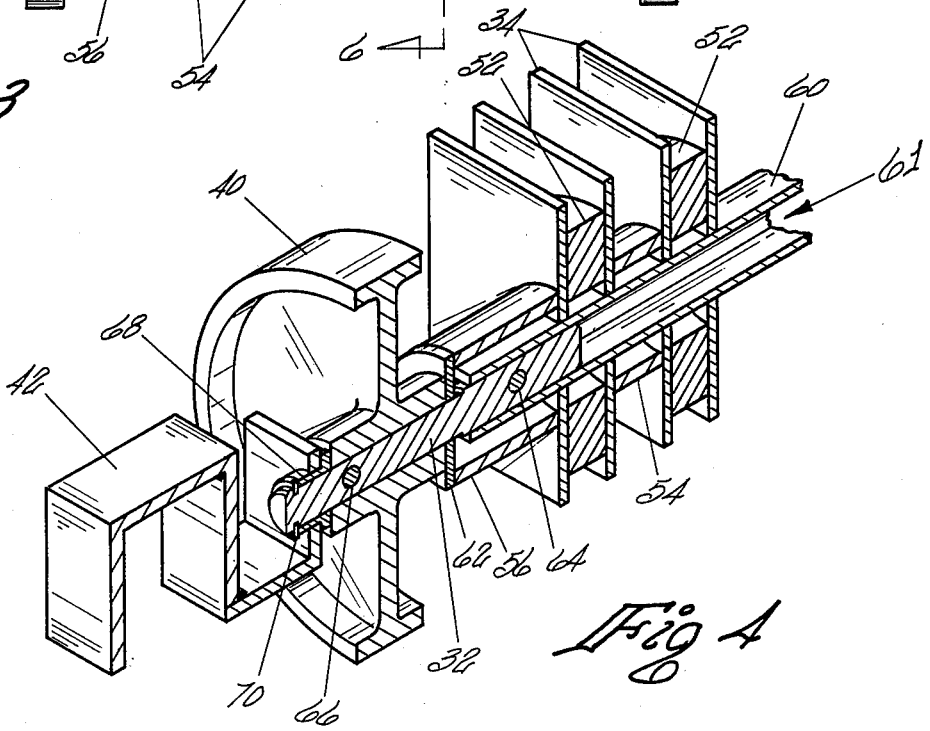
FIG. 4 is a partial orthographic view in cross-section illustrating the construction of an integral assembly formed of magnetic plates, magnetic members, spacing members, elongated support shaft, elongated support pin and annular shaped driving disc rotatably supported within a support housing.

Magnetic members, illustrated in greater detail in FIG. 4, are coaxially aligned with and mounted on the elongated support shaft and located in the space between the metal plates 34. The magnetic members extend substantially vertically outwardly from the support shaft and have a periphery which is spaced a predetermined distance from the periphery of the metal plates. The magnetic members are formed of a magnetic material having a magnetic flux density of sufficient magnitude to magnetize each metal plate 34 to produce a preshaped magnetic field emanating therefrom to attract and remove magnetic articles responsive to the magnetic field from the material flow of rubbish 26 being directed across the metal plates 34 to hold removed magnetic articles, such as knife 25, against the metal plates 34, as the same move relative to the flow of loosely packed material 26 being directed thereacross.

Figure 2:
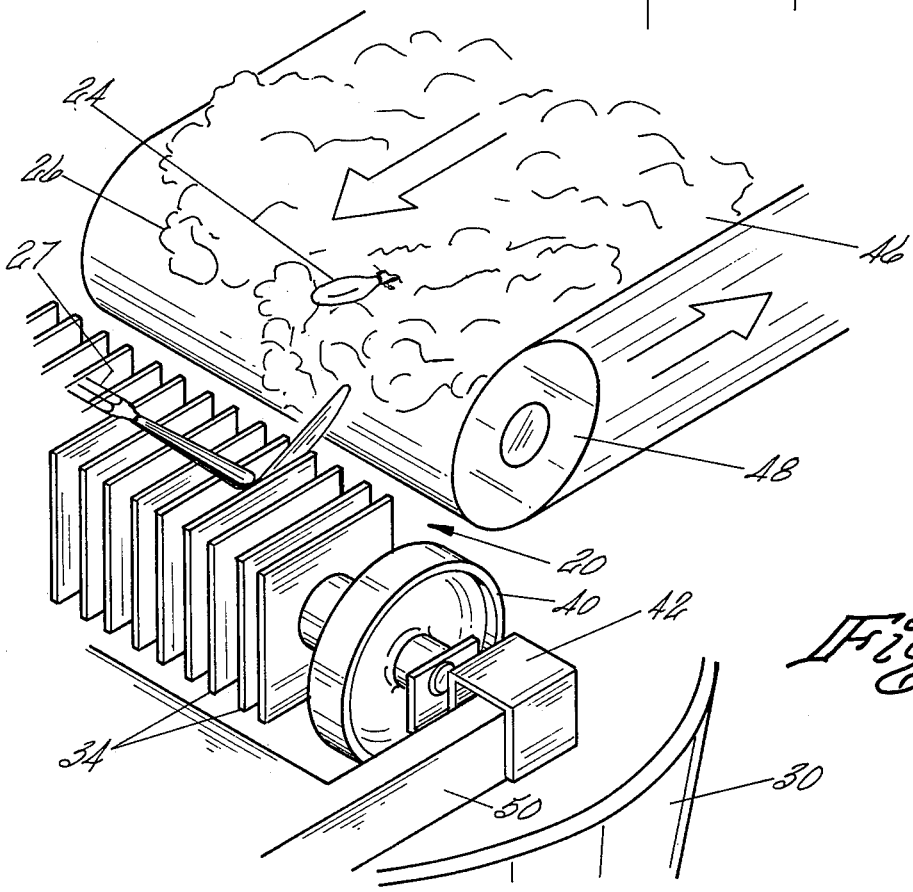
FIG. 2 is a perspective view of the apparatus for removing magnetic articles using the teachings of the present invention which is permanently mounted at the discharge end of a simple conveyer containing a mixture of magnetic articles and non-magnetic articles and a trash receiving receptacle removably mounted therebelow.

As shown in FIG. 2, apparatus for removing magnetic articles 20 is mounted in a different operating relationship. In the embodiment of FIG. 2, a conveyor 46 is adapted to receive the rubbish 26. The magnetic articles, such as silverware 24, is contained within the mixture of magnetic articles and non-magnetic articles defining the loosely packed material 26. A non-magnetic conveyor pulley 48 enables the mixture of magnetic articles and non-magnetic articles to leave the end of the conveyer and be directed in a free fall along a predetermined path enabling the magnetic articles 24 and non-magnetic articles forming the balance of the rubbish to loosely separate from each other. The apparatus 20 establishes a preshaped magnetic field within the free fall predetermined path such that the preshaped magnetic field attracts and removes from the free falling flow of material magnetic articles such as fork 27, to attract the same into engagement with the periphery of the metal plates 34. In addition, the free falling material impact with the periphery of the metal plates 34 and cause the assembly to rotate as an integral assembly. The apparatus 20 is positioned at the end of the conveyor 46 and conveyor pulley 48 by means of a fixed support 50. A support housing 42 is adapted to permit the apparatus 20 to rotate relative to the support 50. A receptacle 30 is positioned below the apparatus to collect the non-magnetic articles from the flow of material which are directed along a predetermined path past a preshaped magnetic field.

During use of the apparatus 20 illustrated in FIGS. 1 and 2 above, once the magnetic articles have been attracted to and are located on the periphery of the metal plates, the metal objects are then removed and reclaimed for reuse.

Figure 3:
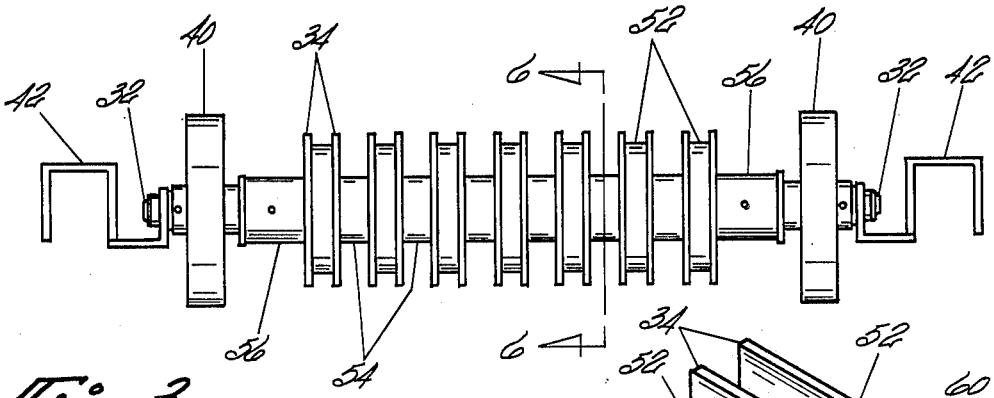
FIG. 3 is a front plan view of an apparatus for removing magnetic articles having a plurality of metal plates, plurality of magnetic members and a plurality of non-magnetic spacing members.

FIG. 3 illustrates the structural arrangement of the integral assembly formed of the metal plates 34, the magnetic members 52, non-magnetic spacing members 54 and 56, annular shaped drive wheel 40, the elongated support pins 32 and the support housings 42. In the embodiment of FIG. 3, the magnetic members are located between every other space of the metal plates 34 with the non-magnetic spacing members 54 being likewise located every other space between the metal plates 34 other than the spaces occupied by the magnetic members 52.

FIG. 4 shows in detail the elongated support shaft 60 which is adapted to be rotated about its longitudinal axis. In the preferred embodiment, the elongated support shaft has a hollowed-out central area 61 and a rectangular cross-section. The metal plates 34 are coaxially aligned with and spaced in a parallel relationship with each other and coaxially aligned and mounted on the elongated support shaft 60 so as to be rotatable therewith.

Magnetic members 52 are likewise coaxially aligned with and mounted on the elongated support shaft 60 and located in the space between the metal plates 34 and are in axial alignment with and contiguous the metal plates 34. The non-magnetic spacing members 54 are likewise coaxially aligned with the elongated support shaft 60 and are located in the space between every other metal plate 34 other than the metal plates having the magnetic members 52.

In FIG. 4, the elongated support pin 32 is located in axial alignment with the elongated support shaft 60 and has one end thereof fixedly connected to one end of the elongated support shaft by means of an alignment pin 64.

Thus, the elongated support shaft 60 is fixed to the elongated support pin 32 through an alignment pin 64 such that the elongated pin 32 and elongated support shaft 60 are rotatable together.

A support housing 42 has the other end of the elongated support pin 32 journaled for rotation therein to enable the elongated support pin 32 and elongated support shaft 60 to rotate relative to the material flow being directed across the metal plates 34.

The annular shaped disc 40 is fixedly mounted on the elongated support pin 32 between the support housing 42 and the end of the elongated support shaft 60. The annular shaped disc 40 is fixed to the elongated support pin 32 by means of a connecting pin 66. The end of the elongated support pin 32 supporting the annular disc 40 is mounted and journaled within the support housing 42 by means of a spacing member 68 and a retainer 70. Support 68 and retainer 70 insure that the assembly is maintained in position and is rotatable relative to the support housing.

Figure 5:
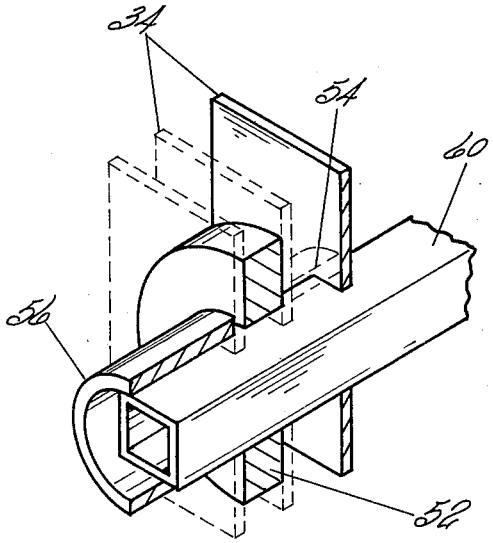
FIG. 5 is a partial diagrammatic view partially in cross section showing an interlocking assembly formed by the magnetic plate mounted on an elongated support shaft including the location of a magnetic member and spacing members relative to the elongated support shaft.
Figure 12:
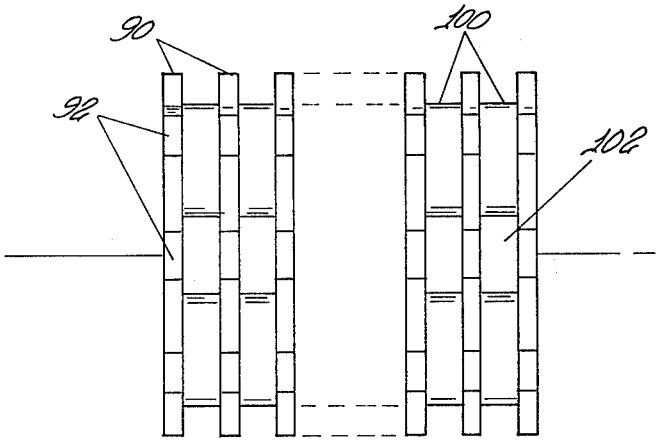
FIG. 12 is a partial front plan view of another embodiment of an apparatus for removing magnetic articles formed of the metal plates having elongated members illustrated in FIG. 10 and the magnetic members having the extended fingers illustrated in FIG. 11.

FIG. 5 shows the spatial relationship between the metal plates 34, one of which is shown in solid configuration and the other which is shown in phantom, and the magnetic member 52. A mon-magnetic spacer 54 is located between the metal plates 34 such that the magnetic members are located in every other space. In construction, the magnetic members are magnetically coupled to the metal plates 34 and are formed of a magnetic material having a magnetic flux density of sufficient magnitude to magnetize each of the metal plates 34 to produce a preshaped magnetic field emanating therefrom. Thus, since each metal plate 34 is magnetically coupled to a magnetic member as illustrated in FIG. 5, a non-magnetic spacer 54 can be utilized between every other metal plate to reduce the necessity for using magnetic members in each space. However, as illustrated in the embodiment of FIG. 12, it is envisioned that magnetic members 52 could be positioned between each of the metal plates 34. As illustrated in FIG. 5, the rectangular metal plates 34 have a rectangular aperture which is illustrated in greater detail in FIG. 7, which positions metal plate 34 in an interlocking arrangement with the elongated support shaft 70. However, the magnetic member 52 has a circular aperture in the center thereof, as illustrated in greater detail in FIG. 8, to permit the magnetic members 52 to rotate if necessary, relative to the elongated support shaft 60. However, since the magnetic members 52 are magnetically coupled to the plates 34, rotation of the interlocking assembly formed by plates 34 and the elongated support shaft 60 would cause the magnetically coupled magnetic members 52 to rotate therewith causing the entire integral assembly to be rotated in response to either the material flow engaging the periphery of the metal plates 34, as illustrated in FIGS. 1 and 2, or a user rotating the annular drive disc 40.

In the preferred embodiment, the magnetic members were formed of a magnetic material known as PERMAG No. MF0009, Grade 5.

Figure 6:
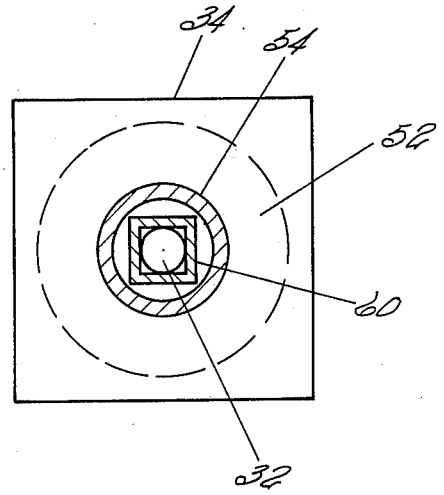
FIG. 6 is an end sectional view taken along section lines 6—6 of FIG. 3.

In the end cross-sectional view of FIG. 6, the rectangular shape of the metal plate 34 is shown in greater detail relative to the circular shape of the magnetic member 52. In FIG. 6 it is readily apparent that the magnetic member 52 extends substantially vertically outwardly from the elongated support shaft 60 and has periphery spaced a predetermined distance from the periphery of each of the metal plates 34. The end of the elongated support pin 32 is shown in its fixed connection to the end of the elongated support shaft 60.

Figure 7:
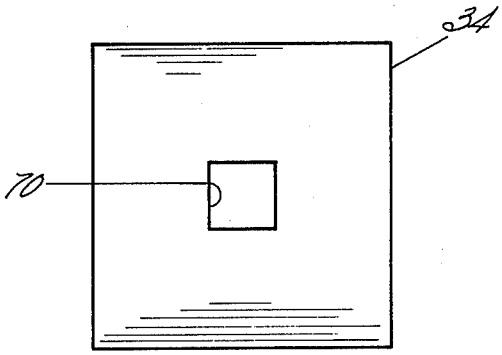
FIG. 7 is a plan end view of a rectangular shaped metal plate.

FIG. 7 shows the embodiment of metal plate 34 which is rectangular in shape. The metal plate 34 has an aperture 70 extending axially therethrough having a rectangular shape of a geometrical dimension to enable each of the metal plates to have the elongated support shaft 60 pass therethrough positioning the interior of the metal plate 34 in locking engagement against the exterior of the elongated support shaft 60.

Figure 8:
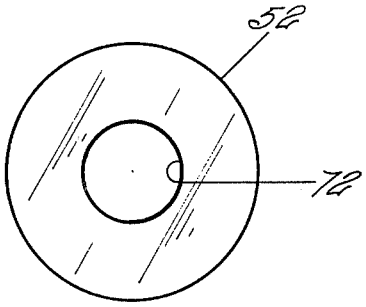
FIG. 8 is a plan end view of an annular shaped magnetic member.

FIG. 8 illustrates magnetic member 52 which is annular in shape. The magnetic member 52 has an aperture 72 extending axially therethrough having a circular cross-section of a geometrical dimension to enable each of the magnetic members to have the elongated support shaft 60 pass therethrough positioning the interior of the magnetic members 52 in sliding relationship against the exterior of the elongated support shaft 60.

Figure 9:
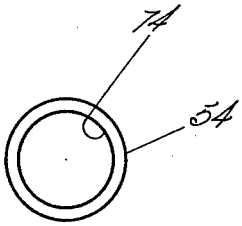
FIG. 9 is an end view of an annular shaped non-magnetic spacing member.

In FIG. 9, the non-magnetic spacing member 54 has a circular shape and is formed of a thin walled spacer having a hollowed-out central area 74.

Figure 10:
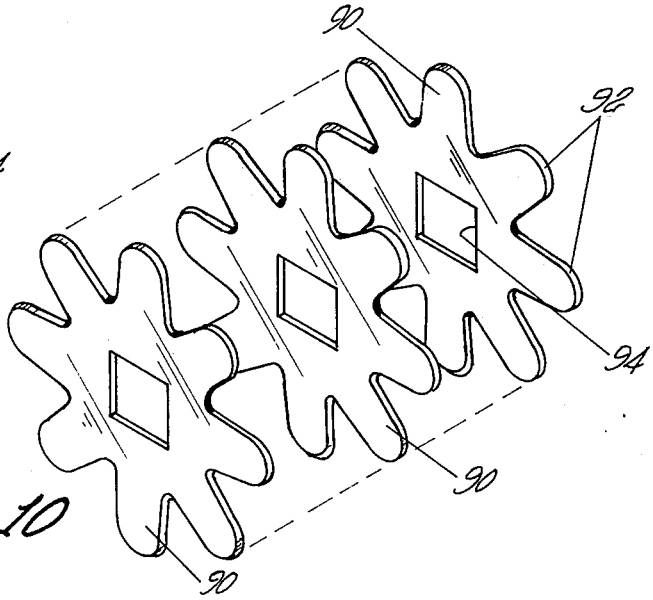
FIG. 10 is an orthographic projection of a different embodiment of the metal plates having elongated members extending therefrom.

FIG. 10 illustrates another embodiment and shape of the metal plates. In FIG. 10, metal plates 90 have a plurality of elongated members 92 extending therefrom, the periphery of which define an annular shaped path. The metal plates 90 have an aperture 94 which is substantially rectangular in shape and is adapted to be mounted upon an elongated support shaft.

Figure 11:
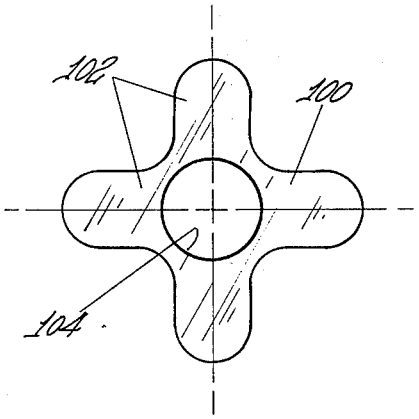
FIG. 11 is a plan end view of yet another embodiment of a magnetic member having a plurality of extended fingers.

FIG. 11 illustrates another embodiment of a magnetic member 100 having a plurality of extended fingers 102 extending therefrom. The magnetic member 100 has aperture 104 which has a circular cross-section and is adapted to have an elongated support shaft pass therethrough.

FIG. 12 illustrates an interlocking assembly formed of metal plates 90 having elongated members 92 which are coaxially aligned in spaced parallel relationship with each other and coaxially aligned and mounted upon elongated support shaft (not shown) so as to be rotatable therewith. Magnetic members 100 coaxially aligned with and mounted on the elongated support shaft (not shown) are located in each of the spaces between the metal plates 90 and in axial alignment and contiguous the metal plates 90. The elongated members 92 of metal plates 90 are adapted to engage and be driven by the flow of loosely packed material. The extended fingers 102 of magnetic member 100 may be positioned, but it is not necessary to do so, in alignment with the extended fingers 92 of metal plates 90.

The primary application of the apparatus is for removing magnetic articles, such as reusable tableware and the like, from rubbish which contains a mixture of the tableware and other articles together with non-magnetic articles, such as food and paper waste.

The method of the present invention for removing magnetically attracted, reusable tableware, and the like from the flow of loosely packed material containing a mixture of magnetic articles and non-magnetic articles, including food and paper waste comprises the steps of directing the flow of loosely packed material in a free fall along a predetermined path enabling the magnetic articles and non-magnetic articles to loosely separate from each other, establishing a preshaped magnetic field within the free fall predetermined path by a plurality of rotatable magnetic members each of which are located between and magnetically coupled to a pair of adjacent metal plates, such that the tableware and other magnetic articles are attracted and removed by the preshaped magnetic field from the free falling flow of material and directed into holding engagement with the periphery of metal plates and wherein a portion of the free falling flow of loosely packed material engages the periphery of the metal plates and the inertia from the free falling material causes the metal plates and the magnetically coupled magnetic members to rotate as an integral assembly, collecting the non-magnetic articles from the flow of material which are directed along the predetermined path and pass the preshaped magnetic field and removing from the periphery of the metal plates tableware or other magnetic articles held thereby.

In the preferred use of the method described above, it is noted that the free flow of material under gravity is along a substantially vertical predetermined path.

As the loosely packed material is directed along the predetermined path, a certain width of the material is produced along the predetermined path.

In the preferred embodiment, it is desirable to have the apparatus positioned substantially across the width of the flow such that the maximum width of the flow engages the metal plates to rotate the integral assembly or to at least pass adjacent thereto to be subjected to the preshaped magnetic field emanating therefrom. Thus, in the preferred embodiment, the step of establishing the preselected magnetic field, includes a further step of positioning the preselected magnetic field substantially normal to the direction of the predetermined path.

As noted here and above, in the preferred embodiment, the force for rotating the apparatus is preferably developed from the free flow of the fallen material upon the metal plates. In the alternative, a drive wheel is provided to rotate the apparatus such that a predetermined portion of the periphery can be placed in engagement with the free flow of loosely packed material. By rotation of the drive wheel, various surfaces of the metal plates can be placed in engagement with the free flow of loosely packed material. The drive wheel could be driven by a drive means, if desired, rather than manually.

In the design of the metal plates 34, it was envisioned that the primary force for rotating the same could be developed from the impact of the free flow material hitting against the periphery of the metal plates. For this reason, the periphery of the metal plates are either square or have the elongated members so as to provide exterior surfaces which would engage and be rotated by the free falling rubbish. However, in the event that the unit is rotated by some type of driving means, the metal plate may take any desired shape.

What is claimed is:

1. Apparatus for removing magnetic articles from a flow of loosely packed material containing a mixture of magnetic articles and non-magnetic articles comprising:

an elongated support shaft adapted to be rotated about its longitudinal axis;

first and second metal plates coaxially aligned in spaced parallel relationship with each other and coaxially aligned with and mounted on said elongated support shaft so as to be rotatable therewith, each of said metal plates extending substantially vertically outwardly therefrom and each having a periphery which is adapted to engage and be rotated by at least one of a said material flow being directed thereacross said elongated support shaft; and a magnetic member coaxially aligned with and mounted on said elongated support shaft and located in the space between the first and second metal plates and in axial alignment with and contiguous said first and second metal plates, said magnetic member extending substantially vertically outwardly from said elongated support shaft and having a periphery spaced a predetermined distance from the periphery of each of said first and second metal plates, said magnetic member being formed of a magnetic material having a magnetic flux density of sufficient magnitude to magnetize each metal plate to produce a preshaped magnetic field emanating therefrom to attract and remove magnetic articles responsive to the magnetic field from a material flow being directed across said metal plates and to hold such removed magnetic articles against said metal plates as the metal plates move relative to the material flow being directed thereacross.

2. The apparatus of claim 1 further comprising a third metal plate coaxially aligned in spaced parallel relationship with at least one of said first and second metal plates and coaxially aligned with and mounted on said elongated support shaft so as to be rotatable therewith, said third metal plate extending substantially vertically outwardly from said elongated support shaft and having a periphery which is adopted to engage and be rotated by at least one of a said material flow and said elongated support shaft.

3. The apparatus of claim 2 further comprising a second magnetic member coaxially aligned with said elongated support shaft and located in the space between said third metal plate and at least one of said first and second metal plates and positioned in axial alignment with and contiguous said third metal plate and at least one of said first and second metal plate, said second magnetic member extending substantially uniformly vertically outwardly from said elongated support shaft and having a periphery spaced a predetermined distance from the periphery of said third metal plate and at least one of said first and second metal plates, said magnetic member being formed of a magnetic material having a magnetic flux density of sufficient magnitude to magnetize each metal plate to produce a preshaped magnetic field emanating therefrom to attract and remove magnetic articles responsive to the preshaped magnetic field from a said material flow being directed across said metal plates and to hold such removed metal articles against said metal plates as the same move relative to the material flow being directed thereacross.

4. The apparatus of claim 3 wherein said elongated support shaft has a hollowed-out central area and a rectangular cross-section and wherein each of said metal plates has an aperture extending axially therethrough having a rectangular shape of a geometrical dimension to enable each of the metal plates to have the elongated support shaft pass therethrough positioning the interior of the metal plate in locking engagement against the exterior of the elongated support shaft wherein the metal plates and elongated support shaft are rotatable as an interlocking assembly.

5. The apparatus of claim 4 wherein each of said magnetic members has an annular shape and has an aperture extending axially therethrough having a circular cross-section of a geometrical dimension to enable each of the magnetic members to have the elongated support shaft pass therethrough positioning the interior of the magnetic members in sliding relationship against the exterior of the elongated support shaft wherein the interlocking assembly of the metal plates and elongated support shaft have the magnetic member positioned therebetween wherein the magnetic member becomes magnetically coupled to each adjacent metal plate forming an integral assembly wherein the magnetically coupled magnetic members are rotatable with the interlocking assembly.

6. The apparatus of claim 5 wherein said magnetic member is formed of permanent magnetic material.

7. The apparatus of claim 2 further comprising a non-magnetic spacing member coaxially aligned with said elongated support shaft and located in the space between said third metal plate and at least one of said first and second metal plates and in axial alignment with said third metal plate and at least one of said first and second metal plates.

8. The apparatus of claim 2 further comprising an elongated support pin located in axial alignment with the elongated support shaft and having one end thereof fixedly connected to one end of said elongated support shaft and being rotatable therewith; and a support housing having the other end of said elongated support pin journeled for rotation in said support housing to enable the elongated support pin and elongated support shaft to rotate relative to the material flow being directed across said metal plates.

9. The apparatus of claim 8 further comprising an annular shaped disc fixedly mounted on said elongated support pin between said support housing and said one end of said elongated support shaft.

10. The apparatus of claim 9 wherein each of said metal plates have a rectangular shape and said magnetic member has a circular shape.

11. Apparatus for separating metal objects from a flow of rubbish comprising an elongated support shaft having a hollowed-out central area and a substantially rectangular cross-section, said elongated support shaft being adapted to be rotated about its longitudinal axis;

a plurality of metal plates coaxially aligned in spaced parallel relationship with each other, each of said metal plates having an aperture extending axially therethrough having a rectangular shape of a geometrical dimension to enable each of the metal plates to have the elongated support shaft pass therethrough positioning the interior of the metal plates in locking engagement against the exterior of the elongated support shaft wherein the metal plates and elongated support shaft are rotatable as an interlocking assembly, each of said metal plates extending substantially vertically outwardly therefrom and each having a periphery which is adapted to engage and be rotated by at least one of a said rubbish being directed thereacross and said elongated support shaft;

a plurality of magnetic members coaxially aligned with and mounted on said elongated support shaft and located in the space between at least every other metal plates, said magnetic members being in axial alignment with and contiguous at least two spaced parallel metal plates and extending substantially vertically outwardly from said elongated support shaft and having a periphery spaced a predetermined distance from the periphery of each of said metal plates, said magnetic members being formed of a magnetic material having a magnetic flux density of sufficient magnitude of magnetize each metal plate to produce a preshaped magnetic field emanating therefrom to attract and remove magnetic articles responsive to the magnetic field from said rubbish being directed thereacross;

a pair of elongated support pins located in axial alignment with the elongated support shaft, each of said elongated support pins having one end thereof fixedly connected to one end of said elongated support shaft and being rotatable therewith;

a pair of support housings each having the other end of one of said pair of support pins journeled for rotation therein to enable the elongated support pins and elongated support shaft to rotate relative to the rubbish flow; and said elongated support shaft, metal plates and magnetic members being adapted to be rotated as an integral assembly relative to the rubbish flow being directed across and into engagement with the metal plates to hold the metal objects removed from the rubbish against the metal plates as the elongated support shaft, metal plates and magnetic members move relative to the rubbish being directed thereby.

12. The apparatus of claim 11 wherein said metal plates are rectangular in shape and wherein said magnetic members are circular in shape.

13. The apparatus of claim 12 further comprising a plurality of non-magnetic spacing members coaxially aligned with said elongated support shaft and located in the spaces between every other of said plurality of metal plates other than the spaces containing said magnetic members.

14. The apparatus of claim 13 wherein said non-magnetic spacing members are circular in shape.

15. The apparatus of claim 14 further comprising an annular shaped driving disc fixedly mounted on one of said pair of elongated support pins between said support housing and adjacent one end of said elongated shaft.

16. The apparatus of claim 11 wherein said metal plates have a plurality of elongated members extending therefrom, the periphery of which define an annular shaped path.

17. The apparatus of claim 11 wherein said magnetic members are located between each metal plate.

18. The apparatus of claim 11 wherein said magnetic members have a plurality of extended fingers extending therefrom the periphery of which define an annular shaped path.

19. The apparatus of claim 11 wherein said magnetic member is formed of a hard, permanent magnetic material.

20. A method of removing magnetically attracted, reusable tableware and the like from a flow of loosely packed material containing a mixture of magnetic articles and non-magnetic articles including food and paper waste comprising the steps of directing the flow of loosely packed material in a free fall along a predetermined path enabling the magnetic articles and non-magnetic articles to separate from each other;

establishing a preshaped magnetic field within the free fall predetermined path by a plurality of rotatable aligned spaced metal plates having a plurality of rotatable magnetic members each of which are located between and magnetically coupled to a pair of adjacent metal plates such that tableware and other magnetic articles are attracted and removed by the preshaped magnetic field from the free falling flow of material and directed into holding engagement with the periphery of the metal plates and wherein a portion of the free falling flow of loosely packed material engage the periphery of the metal plates and the inertia from the free falling material causes the metal plates and the magnetically coupled magnetic members to rotate as an integral assembly;

collecting the non-magnetic articles from the flow of material which are directed along the predetermined path and past the preshaped magnetic field; and removing from the periphery of the metal plates the tableware and other magnetic articles held thereby.

21. The method of claim 20 wherein the step of establishing the preselected magnetic field including the further step of positioning the preselected magnetic field substantially normal to the direction of the predetermined path.

* * * * *